US006823034B1

(12) United States Patent
Doman

(10) Patent No.: US 6,823,034 B1
(45) Date of Patent: Nov. 23, 2004

(54) CLOSURE MECHANISM AND METHOD FOR SPENT NUCLEAR FUEL CANISTERS

(75) Inventor: Marvin J. Doman, Monroeville, PA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/779,894

(22) Filed: Mar. 31, 2000

(51) Int. Cl.[7] ..... G21C 19/00; G21F 5/00

(52) U.S. Cl. ..... 376/272; 250/506.1; 220/256.1; 220/315; 220/319

(58) Field of Search ..... 376/272; 250/506.1, 250/507.1; 220/256.1, 315, 319

(56) References Cited

U.S. PATENT DOCUMENTS 4,016,096 A * 4/1977 Meyer ..... 376/272
4,197,467 A * 4/1980 Williams ..... 376/272
4,274,007 A * 6/1981 Baatz et al. ..... 376/272
4,381,844 A * 5/1983 Bondy ..... 376/272
4,567,014 A * 1/1986 Popp et al. ..... 250/506.1
4,596,688 A * 6/1986 Popp ..... 250/506.1
4,626,402 A * 12/1986 Baatz et al. ..... 376/272
4,636,645 A * 1/1987 Kessinger ..... 250/506.1
4,754,894 A * 7/1988 Simon et al. ..... 250/506.1
4,775,074 A * 10/1988 Ershig ..... 250/506.1
4,777,874 A * 10/1988 Manning ..... 376/272
4,818,878 A * 4/1989 Popp et al. ..... 250/506.1
5,548,992 A 8/1996 Hallett et al. ..... 73/49.2

* cited by examiner

*Primary Examiner*—Harvey E. Behrend
(74) *Attorney, Agent, or Firm*—Richard A. Morgan; Paul A. Gottlieb

(57) ABSTRACT

A canister is provided for storing, transporting, and/or disposing of spent nuclear fuel. The canister includes a canister shell, a top shield plug disposed within the canister, and a leak-tight closure arrangement. The closure arrangement includes a shear ring which forms a containment boundary of the canister, and which is welded to the canister shell and top shield plug. An outer seal plate, forming an outer seal, is disposed above the shear ring and is welded to the shield plug and the canister.

13 Claims, 2 Drawing Sheets

CLOSURE MECHANISM AND METHOD FOR SPENT NUCLEAR FUEL CANISTERS

CONTRACTUAL ORIGIN OF THE INVENTION

The United States Government has rights in this invention under a contract with the Department of Energy.

BACKGROUND OF THE INVENTION

1. Field of the Invention

The present invention relates to canisters for storing, transporting and/or disposing of spent nuclear fuel and, more particularly, to an improved closure mechanism for such canisters, and a method of ensuring leaktight closure of such canisters.

2. Related Art

Spent nuclear fuel is placed into canisters for storage and transportation, and in some instances, for permanent disposal in a geologic repository. As shown in FIG. 1, a typical canister, generally denoted 10, comprises a right-circular cylinder 12 with a bottom plate 14. As can best be seen in FIG. 2, the canister closure at the top of the cylinder 12 includes an outer lid 16 and an inner lid 18, with the canister 10 further including a shield plug 20 for the spent nuclear fuel, denoted SF. The two lids 16 and 18 are field welded, by welds indicated at 22 and 24, after the spent fuel SF and shield plug 20 are installed in the canister 10. It is noted that the spent fuel requirements of Title 10 of the Code of Federal Regulations, Part 72(10 C.F.R. §72) requires redundant seals such as two welded lids. It should also be pointed out that some conventional canister designs weld the shield plug directly to the canister in order to eliminate the need for an inner lid.

ANSI N14.5, American National Standard for Radioactive Materials-Leakage Tests on Packages for Shipment, specifies the methods for demonstrating that Type B radioactive material transportation packages comply with the containment requirements of 10 C.F.R. §71. ANSI N14.5 is also the standard applied to spent fuel storage systems and defines the word "leaktight" as a leakage rate no greater than $1\times10^{-7}$ standard cubic centimeter per second (std $cm^3/s$). If it can be demonstrated that a package is leaktight, the package can be stored or shipped without consideration of the package contents. On the other hand, leak rates which are greater than leaktight have to be evaluated against the contents of the package to demonstrate acceptability. ANSI 14.5 also identifies the sensitivity range for a helium mass spectrometer "sniffer" test as $1\times10^{-3}$ to $1\times10^{-6}$ std $cm^3/s$ and the sensitivity range for a helium mass spectrometer "envelope" test as $1\times10^{-3}$ std $cm^3/s$ to $1\times10^{-8}$ std $cm^3/s$.

The typical fuel canister is leak tested using the helium mass spectrometer sniffer test. In this test, after the inner lid is welded to the canister, the canister is filled with helium and the weld joint is tested. The actual sniffer test simply consists of using a probe which is connected to a mass spectrometer and which is held near the weld to sample the ambient air for helium. Once the inner lid penetration is sealed, the void between the inner and outer lids is filled with helium and the sniffer leak test is repeated for the outer lid in the same manner. Such testing indicates that a typical canister has a leak rate of no greater than about $1\times10^{-5}$ std $cm^3/s$.

SUMMARY OF THE INVENTION

In accordance with one aspect of the invention, a canister is provided for storing, transporting, or disposing of spent nuclear fuel, the canister comprising a canister shell, a top shield plug disposed within the canister, and a leak-tight closure arrangement, the closure arrangement comprising: a shear ring forming a containment boundary of the canister, and weld means for welding the shear ring to the canister shell and to the top shield plug.

Advantageously, the shear ring comprises a plurality of pieces welded together, although the shear ring can also be of one piece construction.

Preferably, an outer seal plate is disposed above said shear ring and welded to the shield plug and the canister.

Advantageously, the shield plug includes bolt holes, drilled in an outer surface thereof, for attaching a lifter thereto.

In a beneficial implementation, the mating surfaces of the shear ring and the canister shell are tapered.

In accordance with a further aspect of the invention, a method is provided for producing a leaktight closure for a canister comprising a canister shell and a top shield plug, the method comprising: welding a shear ring to the canister shell and to the top shield plug, supplying a test gas to the canister, welding an outer seal plate to the canister so as to seal the canister and create a space between the seal plate and the shield plug, sampling the air between the shield plug and the seal plate to test internal sealing of the canister, supplying a test gas to the space between the seal plate and shield plug, and testing the outer seal plate for leakage.

Supplying a test gas to the canister preferably comprises removing a pipe plug in the canister, filling the canister with helium and reinstalling the pipe plug after the filling step.

In an advantageous implementation, a leak test adapter is installed on the seal plate after welding of the seal plate and a mass spectrometer is connected to the adapter to sample the air between the shield plug and the seal plate. Preferably, supplying of the test gas to the space between seal plate and shield plug comprises filling the space with helium, and the method further comprises removing the leak test adapter, and using a seal plug to seal the outer seal plate.

Further features and advantages of the present invention will be set forth in, or apparent from, the detailed description of preferred embodiments thereof which follows.

DESCRIPTION OF THE PREFERRED EMBODIMENTS

Figure 1:
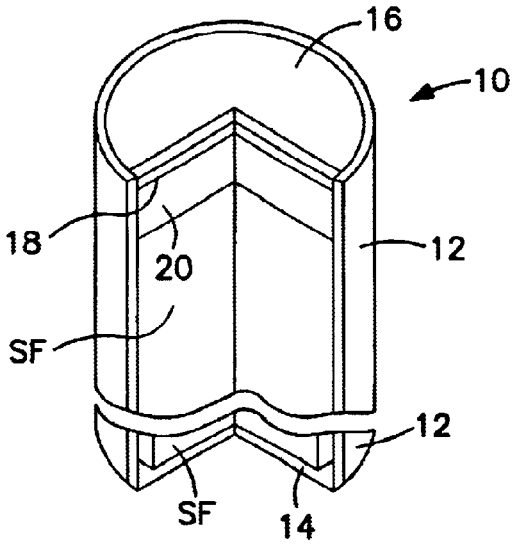
FIG. 1 PRIOR ART
FIGS. 1 and 2, which were described above, are a cutaway perspective view and a detail of the perspective view, respectively, of a prior art canister.
Figure 2:
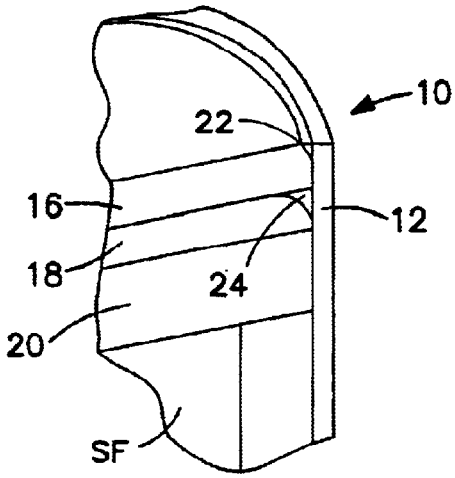
FIG. 2 PRIOR ART
Figure 3:
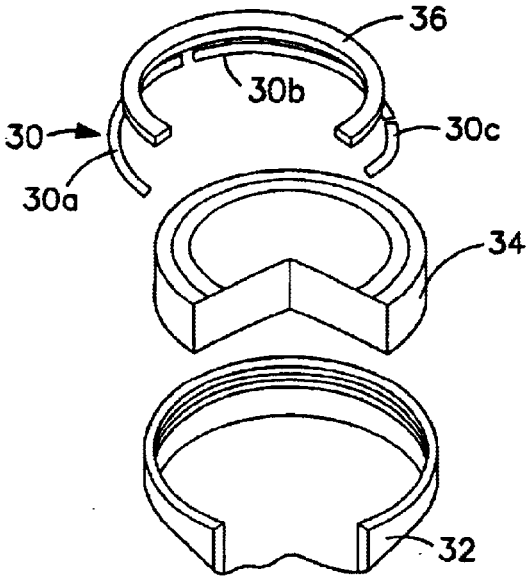
FIG. 3 is an exploded perspective view of the canister closure mechanism of the invention.
Figure 4:
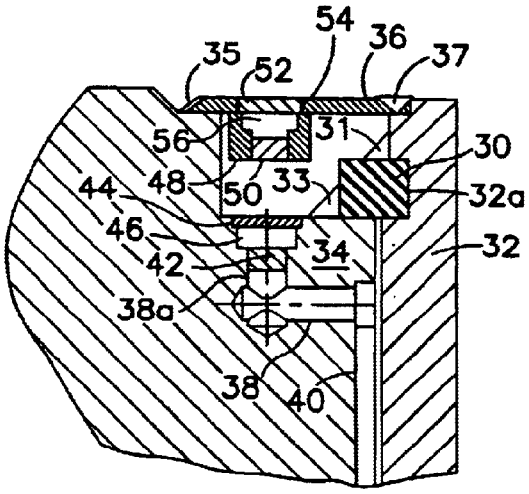
FIG. 4 is a cross sectional view of a fully assembled canister incorporating the canister closure mechanism of the invention.

Referring to FIG. 3, the basic components of the leaktight closure mechanism of the invention include a three-piece segmented shear ring 30, including pieces 30*a*, 30*b* and 30*c*. It will be understood that a one-piece, spliced shear ring or a two-piece shear ring could also be used. In the illustrated embodiment, the container containment boundary for the canister cylinder 32 is formed by welding the three segments together and welding the resultant shear ring 30 to the canister shell 32 and to the top shield plug assembly including shield plug 34. This is shown in FIG. 4 wherein, as illustrated, shear ring 30 is received in an annular recess 32*a* in the inner wall of shell 32 and is welded by a weld 31 to shell 32 and by a weld 33 to shield plug 34. As is also shown in FIG. 4, an outer seal plate 36 is welded by respective welds 35 and 37 to the shield plug 34 and the shell 32, respectively. Outer seal plate 36 provides the redundant seal required by 10 C.F.R. §72.

As shown in FIG. 4, the canister 10 also includes canister leak testing components which are located on the circumference of the shield plug 34 and the seal plate 36. The components, which are conventional, include an L-shaped hole 38 connected to a vertical channel 40 in the shield plug 34 which communicates with the interior of the canister 10, a pipe plug 42 disposed in the vertical leg 38*a* of hole 38 and seal plug 44 which seals off a larger diameter opening 46 which is connected to pipe leg 38*a*. In addition, outer seal plate 36 includes an outer seal plate boss 48 in which a pipe plug 50 is received and a seal plug 52 for sealing opening 54 in seal plate 36. An intermediate diameter opening 56 is disposed between, and provides communication between, upper opening 54 and the smaller diameter opening in which pipe plug 50 is received.

Figure 5:
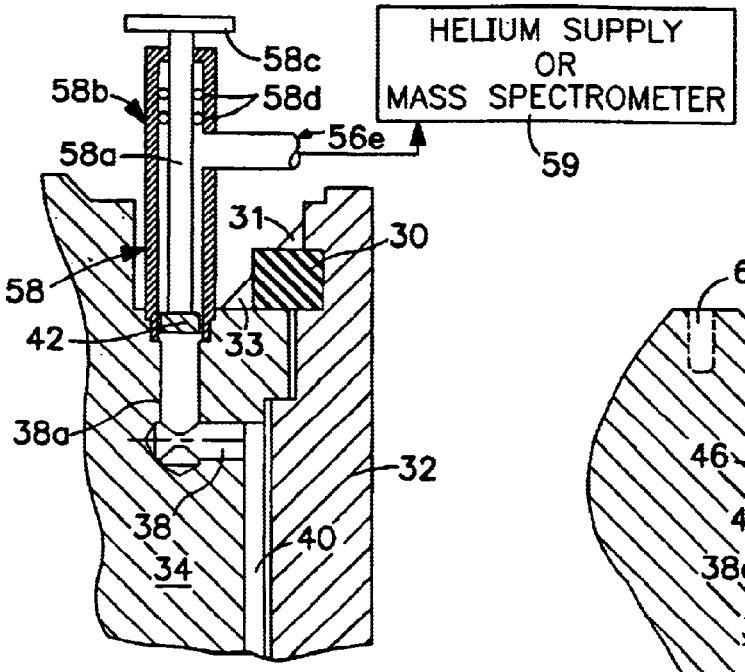
FIGS. 5 to 7 are cross sectional views, showing steps in the assembly and testing of the canister of FIG. 4.

Once the shear ring seal welds 31 and 33 are completed, a leak test adapter 58 of the kind disclosed in U.S. Pat. No. 5,548,992 (Hallett et al) is installed in the shield plug penetration, as shown in FIG. 5. In general, adaptor 58 includes a stem member 58*a,* which is received in a cylindrical body 58*b,* operated by handle 58*c* and sealed by o-rings 58*d,* and which is used, inter alia, to remove pipe plugs such as plug 42 and thus open a connection to a helium supply or mass spectrometer, indicated at 59, through a branch connector 58*e*. Reference is made to the Hallett et al patent, which is hereby incorporated by reference, for more details with respect to adaptor 58. The adaptor 58 is used in FIG. 5 to remove the pipe plug 42 (as illustrated), evacuate the canister 10, and reinstall the pipe plug 42 once the canister 10 is filled with helium.

Figure 6:
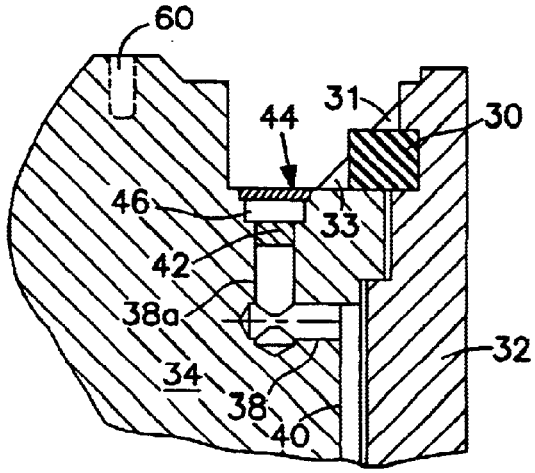

Referring to FIG. 6, after these operations are completed, the seal plug 44 is, as illustrated, welded to the shield plug 34.

Figure 7:
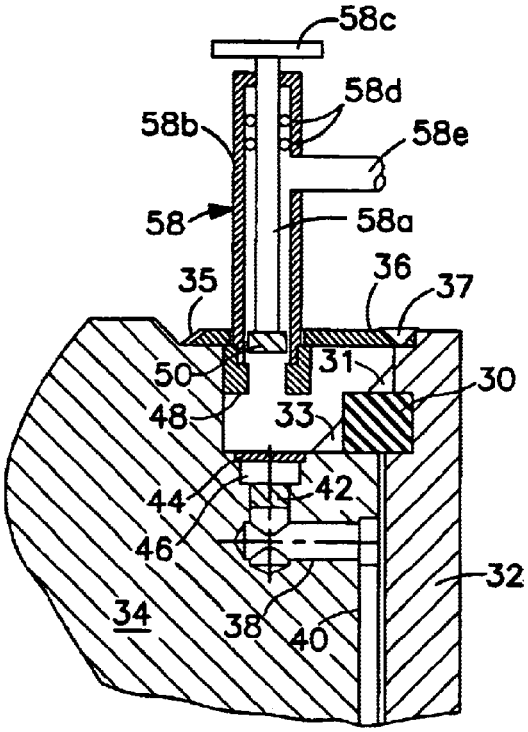

Referring to FIG. 7, in a further step, after the outer seal plate 36 is welded to the shield plug 34 (by weld 35) and to the shell 32 (by weld 37), the leak test adapter 58 is installed in the outer seal plate boss 48, as illustrated. Once the leak test adapter 58 is installed, the adapter 58 is connected to a mass spectrometer (such as that indicated generally at 59 in FIG. 5) which is used to sample the air between the shield plug 34 and the outer seal plate 36. This process is referred to as a helium mass spectrometer envelope leak test and can be used to demonstrate that the inner seal is leak tight (i.e., has leakage rate less than or equal to $1\times10^{-7}$ std $cm^3/s$. This is an improvement over the current state of the art sniffer test which is limited to demonstrating leaks no greater than about $1\times10^{-5}$ std $cm^3/s$.

Once the inner seal is tested, the void or space between the shield plug 34 and the outer seal plate 36 is filled with helium, the pipe plug 50 is installed, the leak test adapter 58 is removed, and the seal plug 52 is welded to the penetration or opening of the outer seal plate 36. A sniff test is then performed on the outer seal plate 36 to demonstrate a leak rate of no greater than about $1\times10^{-5}$ std $cm^3/s$.

The weld shear ring arrangement of the invention does not require specific alignment of the shield plug 34 and the various weld joints are backed by the shear ring 30, shield plug 34, and canister shell 32. The weld joint geometry can be sized to be structurally adequate, while affording the required clearances needed to install the shear ring 30. Preliminary testing has indicated that preferential weld distortion eliminates these clearances, thereby resulting in metal-to-metal contact between the shield plug 34 and shear ring 30 and between the shear ring 30 and the canister shell 32. This is an improvement over the current state of the art which relies on the closure welds 22 and 24 for lifting. The metal-to-metal contact between the shield plug 34 and shear ring 30 and canister shell 32 results in the shear ring 30 being the load bearing member and the welds 31 and 33 being classified as seal welds.

Figure 8:
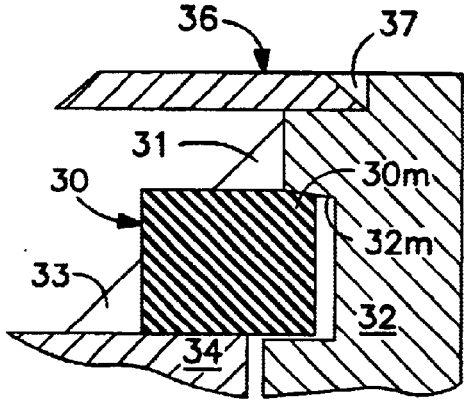
FIG. 8 is a cross sectional view showing a detail of the canister and illustrating an alternative embodiment of the shear ring of FIGS. 3 to 7.

In an alternative embodiment illustrated in FIG. 8, the mating surfaces 30*m* and 32*m* between the shear ring 30 and the canister shell 32 are sloped or tapered to ensure metal-to-metal contact between these components prior to welding.

To permit lifting with the thick shield plug 34 and to provide a redundant seal, the outer seal plate 36, as indicated above, comprises a ring which is welded, by welds 35 and 37 respectively, to the shield plug 34 and canister shell 32. Lifting with the shield plug 34 (rather than an outer lid 16 which is the state of the art method) is preferred because the plug 34 is very rigid and reduces the bending moment which is applied to the canister shell 32. Lifting is accomplished by attaching safety hoist rings (not shown) or a grapple adapter (not shown) to the shield plug 34 using bolt holes drilled in the outer surface of the plug 34. One such bolt hole, denoted 60, is indicated in FIG. 6. The force required to lift the canister is transmitted from the lift attachments, through the shield plug 34, to the shear ring 30 which contacts or bears on the canister shell 32. Some of the lifting load is transmitted to the seal welds 31 and 33 but the primary load is through the shear ring 30. The shear ring 30 could lift the canister without the two seal welds 31 and 33 and thus, the weld shear ring provides a "defense-in-depth" approach and improved safety for lifting the spent fuel canister.

Although the invention has been described above in relation to preferred embodiments thereof, it will be understood by those skilled in the art that variation and modifications can be effected in these preferred embodiments without departing from the scope and spirit of the invention.

I claim:

1. A canister for storing, transporting, or disposing of spent nuclear fuel, said canister comprising a canister shell, a top shield plug disposed within said canister, and a leak-tight closure arrangement, said closure arrangement comprising:

a shear ring forming a containment boundary of said canister, and weld means for welding the shear ring to said canister shell and to said top shield plug.

2. The canister of claim 1 wherein said shear ring comprises a plurality of pieces welded together.

3. The canister of claim 1 wherein said shear ring comprises three pieces welded together.

4. The canister of claim 1 further comprising an outer seal plate disposed above said shear ring and welded to said shield plug and said canister.

5. The canister of claim 1, wherein said shear ring is used as the load bearing member and the welds are seal welds.

6. The canister of claim 1, wherein mating surface of the shear ring and the canister shell are tapered.

7. The canister of claim 4 further comprising a space for air or gas between said outer seal plate and said shield plug.

8. The canister of claim 7 including leak testing components.

9. The canister of claim 8 wherein said leak testing components comprise an L-shaped hole connected to a vertical channel in said shield plug, said channel communicating with the interior of said canister.

10. The canister of claim 9 further comprising a pipe plug disposed in a vertical leg of said L-shaped hole.

11. The canister of claim 10 further comprising an outer seal plate boss on said outer seal plate, a pipe plug in said outer seal plate boss, and a seal plug in said outer seal plate for sealing an opening in said seal plate.

12. A spent nuclear fuel canister comprising a canister shell, a top shield plug disposed within the canister, and a leak-tight closure, the closure comprising:

a load bearing shear ring forming a containment boundary in the canister, and seal welds attaching the shear ring to the canister shell and to the top shield plug.

13. The spent nuclear fuel canister of claim 12 wherein the shear ring is mated with an annular groove in the canister shell.

* * * * *

UNITED STATES PATENT AND TRADEMARK OFFICE

CERTIFICATE OF CORRECTION

PATENT NO. : 6,823,034 B1 
DATED : November 23, 2004
INVENTOR(S) : Marvin J. Doman et al.

It is certified that error appears in the above-identified patent and that said Letters Patent is hereby corrected as shown below:

Title page,
Item [75], Inventors, should read as follows:
-- Marvin J. Doman, Monroeville, PA
Suzanne Fiscus, Idaho Falls, ID
Brian H. Hallett, Elizabeth, PA
Anthony J. Peila, Greensburg, PA
Alex L. Primas, Pittsburgh, PA --.
Insert Item -- [63] Claims Priority
Provisional SN 60/127,555 filed March 31, 1999 --.

Signed and Sealed this

Sixth Day of December, 2005

JON W. DUDAS
*Director of the United States Patent and Trademark Office*